US009719513B2

(12) United States Patent
Geue et al.

(10) Patent No.: US 9,719,513 B2
(45) Date of Patent: Aug. 1, 2017

(54) VACUUM PUMP

(71) Applicant: Hella KGaA Hueck & Co., Lippstadt (DE)

(72) Inventors: Ingo Geue, Bad Sassendorf (DE); Theodor Hüser, Geseke (DE); Dietmar Rech, Oberwesel (DE); Thomas Valeiras Fernandez, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 145 days.

(21) Appl. No.: 14/104,813

(22) Filed: Dec. 12, 2013

(65) Prior Publication Data

US 2014/0169992 A1 Jun. 19, 2014

(30) Foreign Application Priority Data

Dec. 18, 2012 (DE) ..... 10 2012 112 465

(51) Int. Cl.

| | |
|---|---|
| ***F04C 29/00*** | (2006.01) |
| ***F04C 29/06*** | (2006.01) |
| *F04C 25/02* | (2006.01) |
| *F04B 39/16* | (2006.01) |
| *F04C 18/344* | (2006.01) |

(52) U.S. Cl.

CPC ..... *F04C 29/0092* (2013.01); *F04C 29/065* (2013.01); *F04C 29/066* (2013.01); *F04B 39/16* (2013.01); *F04C 18/344* (2013.01); *F04C 25/02* (2013.01); *F04C 2220/10* (2013.01)

(58) Field of Classification Search

CPC .... F04B 39/16; F04C 29/0092; F04C 29/065; F04C 29/066; F04C 29/068; F04C 25/02; F04C 18/344; F04C 2210/10; F04D 29/70; F04D 29/701; F04D 29/708

USPC ..... 417/410.3, 423.9

See application file for complete search history.

(56) References Cited

U.S. PATENT DOCUMENTS

| | | | | |
|---|---|---|---|---|
| 4,019,836 A * | 4/1977 | Deters | F04D 13/10 415/901 |
| 4,512,201 A * | 4/1985 | Konrad et al. | G01F 1/06 73/861.79 |
| 4,930,982 A * | 6/1990 | Channell | F04D 13/10 415/121.2 |
| 5,184,946 A * | 2/1993 | Sato | B60S 1/481 417/360 |

(Continued)

FOREIGN PATENT DOCUMENTS

| | | |
|---|---|---|
| CN | 201661465 U * | 12/2010 |
| DE | 4239575 C2 | 11/1995 |

(Continued)

*Primary Examiner* — Theodore Stigell
*Assistant Examiner* — Chirag Jariwala
(74) *Attorney, Agent, or Firm* — Husch Blackwell LLP

(57) ABSTRACT

A pump includes a pump chamber in which a rotor with gates is supported so that it can rotate, an electric motor for driving the rotor, an outlet, and an inlet port that is fastened to a mounting plate and is in active connection with an inlet channel. The pump should be improved so that its service life and reliability are improved with minimal installation complexity in a vehicle, wherein intense cleaning of lines and devices connected on the suction side can be eliminated. This is achieved in that a filter is arranged in the area of the inlet channel between the mounting plate and the pump chamber.

4 Claims, 3 Drawing Sheets

(56) References Cited

U.S. PATENT DOCUMENTS

| | | | | |
|---|---|---|---|---|
| 5,868,175 | A * | 2/1999 | Duff | B67D 7/0486 141/192 |
| 6,254,354 | B1 * | 7/2001 | Sonnier, Jr. et al. | F04B 39/16 417/53 |
| 7,168,387 | B1 * | 1/2007 | Al-Garni | B63C 11/02 114/312 |
| 8,876,929 | B2 * | 11/2014 | Osawa | H01M 8/04097 210/360.1 |
| 8,919,236 | B2 * | 12/2014 | Bell | E21B 43/116 166/297 |
| 2010/0319798 | A1 * | 12/2010 | Lim et al. | F04C 25/02 137/899 |

FOREIGN PATENT DOCUMENTS

| | | | |
|---|---|---|---|
| DE | 20105280 | U1 | 9/2002 |
| DE | 102006058978 | A1 | 6/2008 |

* cited by examiner

VACUUM PUMP

CROSS REFERENCE

This application claims priority to German Patent Application No. 10 2012 112465.5, filed Dec. 18, 2012.

TECHNICAL FIELD OF THE INVENTION

The invention relates to a pump with a pump chamber in which a rotor with gates is supported so that it can rotate, an electric motor for driving the rotor, an outlet, and an intake port that is fastened to a mounting plate and is in active connection with inlet channels.

BACKGROUND OF THE INVENTION

Such pumps are known and are also designated as vane cell pumps in their construction. They are used for feeding gases or fluids and are used, e.g., in motor vehicles preferably as vacuum pumps for engine management and/or for boosting the braking force.

In DE 10 2006 058 978 A1, a pump (vane cell pump) is described in which a pump chamber comprises a pump ring that is arranged between a base plate and a cover plate. To reduce the sound, a muffler is provided. So that the gates are not tilted during operation and gate fractures are prevented, inlet openings are chamfered in the base plate.

From DE 42 39 575 C2, a muffler for vane cell pumps is known that is divided into two parts. One part is the suction side and the other part is the outlet side of the pump. A filter sieve is arranged in the other part, in order to keep particles generated during production away from sensitive loads.

In the prior art it is not known to protect the sensitive pump itself from particles with filters, in order to guarantee the reliability and service life of the pump. It is only known to suction air from locations at which a particle load is relatively low. For this purpose, corresponding lines that reduce the pump output and increase the installation expense are required in vehicles. In addition, for vacuum pumps, the suction lines and the devices that are to be supplied with the low pressure must be produced and installed under especially clean conditions, which greatly increases the costs. Furthermore, filters are known that are arranged outside the pump. These filters increase the installation expense and require additional installation space.

Therefore, the problem of the invention is to create a pump whose service life and reliability are improved with minimal installation expense in a vehicle, wherein intense cleaning of lines and devices connected on the suction side can be eliminated.

SUMMARY OF THE INVENTION

In the area of the inlet channel between the mounting plate and the pump chamber there is a filter. The filter has the effect that particles are reliably kept away from the sensitive parts of the pump—namely the pump chamber and the rotor with the gates. Here it is not significant whether particles are present in the parts that are connected before the pump on the suction side and comprise suction lines and also, e.g., a brake booster. These parts therefore must be cleaned only relatively coarsely before installation in a motor vehicle. During the installation, cleanliness is also not an absolute requirement. This significantly simplifies and makes more inexpensive the production and installation of the parts, while the filter causes only minimal added costs. Overall, the costs for the production of the motor vehicle is reduced.

In one construction, a frame of the filter is formed with sealing lips. Here, the sealing lips are arranged on an outer periphery and optionally on an inner periphery of the frame. This seals the filter securely against the inlet channel, so that the suction air flow cannot bypass the filter.

In another construction, the filter is arranged in the inlet channel. In this way, relatively large active filter surface areas can be realized with low expense.

In another construction, the frame is shaped like a Celtic cross, wherein filter surface areas are formed with a filter medium in arms that extend outward. This means that the frame has a circular ring-shaped base surface on whose outer periphery the arms are molded in a cross shape distributed in the form of rectangles. A filter surface does not need to be formed in each of the filter arms. In this way, the filter is adapted to the shape of a suction channel that is formed in the mounting plate and the filter surfaces are constructed where they are needed.

In another construction, webs are formed on the frame. This simplifies the installation and here, in particular, the axial orientation of the filter on the mounting plate.

In another construction, the frame has a mirror-symmetric shape. This simplifies the error-free installation and prevents the frame from deforming.

In another construction, a muffler that encloses a volume around the pump chamber is allocated to the outlet, wherein the volume is in active connection with an outlet port. In this way, the noise emissions of the pump are significantly reduced.

In another construction, a front filter is arranged in the muffler. This further prevents the noise emissions, without significantly degrading the pump output.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
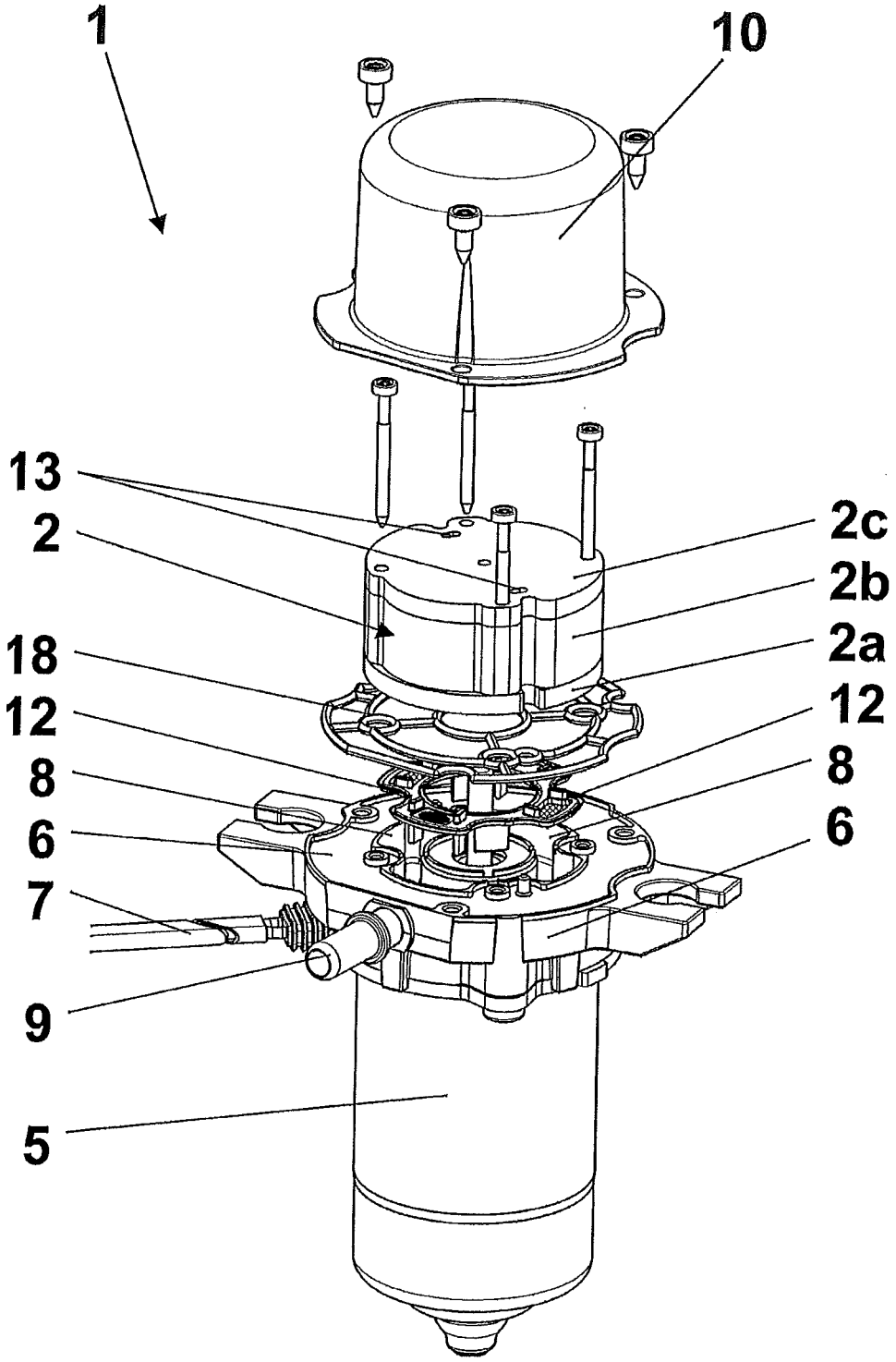
FIG. 1 an exploded view of a pump.
Figure 2:
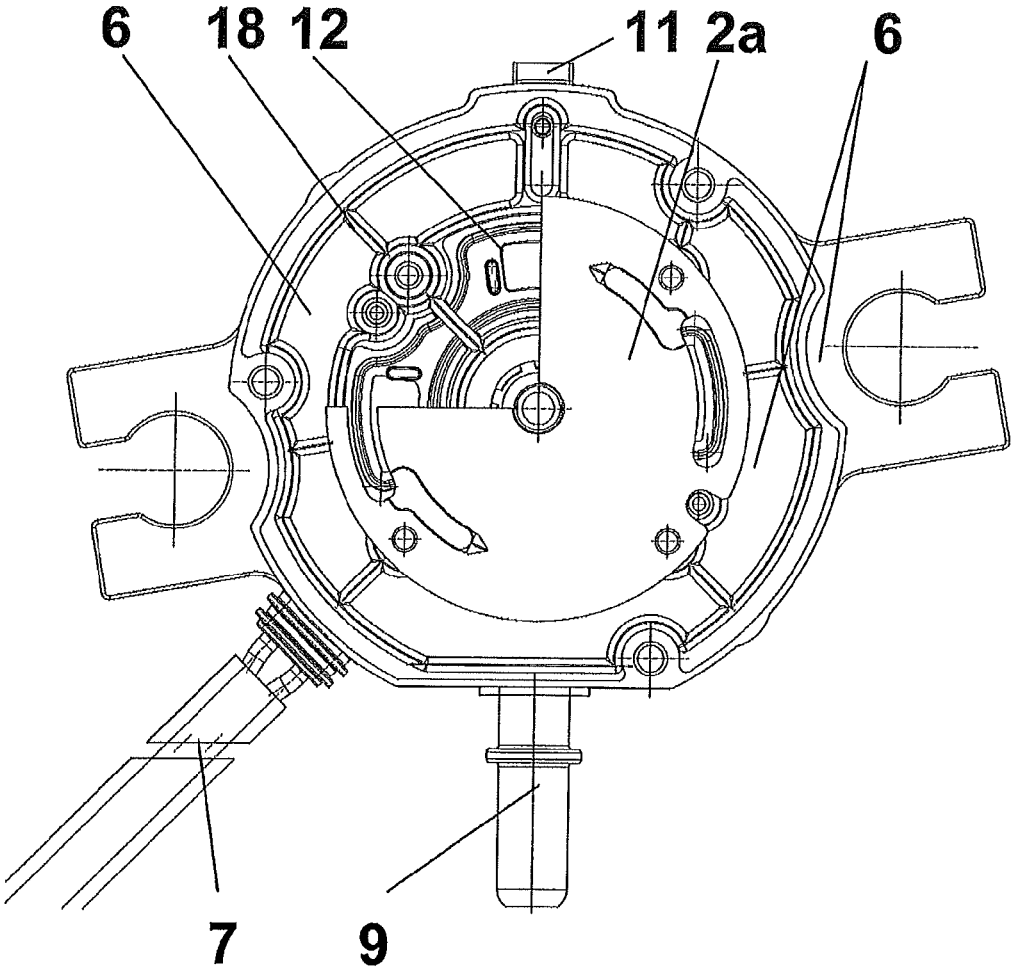
FIG. 2 a top view of a mounting plate of the pump with base plate, partially sectioned, FIG. 3 a vertical section of the mounting plate with a filter, and FIG. 4 a perspective view of the filter.
Figure 3:
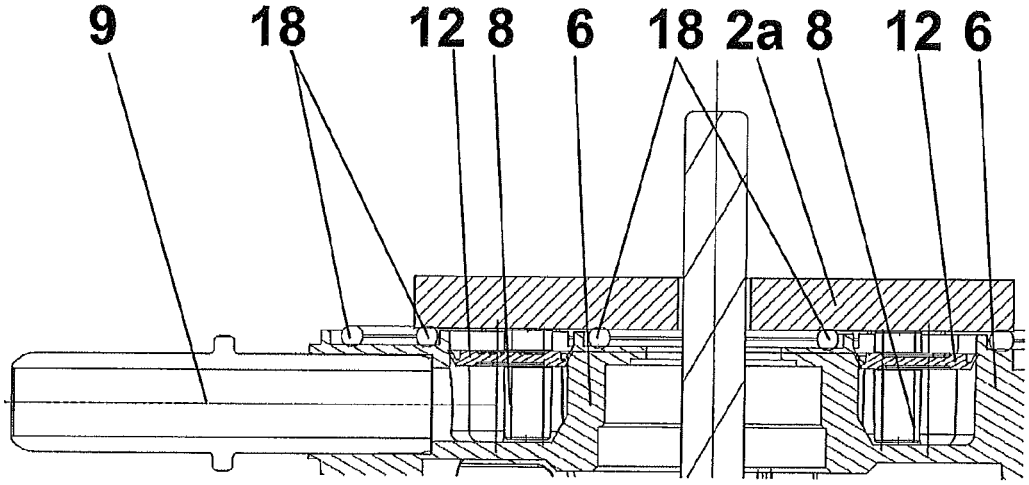

As can be seen from FIGS. 1 to 3, a pump 1, here a vane cell pump that is defined as a vacuum pump, comprises a pump chamber 2 in which a rotor is supported so that it can rotate. Gates are arranged in the rotor so that they can slide, as usual. The rotor can be driven by means of an electric motor 5 that is fastened to a mounting plate 6. The motor 5 is here surrounded by a housing and attached to a connecting cable 7.

The pump chamber 2 is formed from a base plate 2*a* with slot-shaped inlet openings, a pump ring 2*b*, and a cover plate 2*c* and is connected in terms of flow via an inlet channel 8 to an inlet port 9 and via a muffler 10 to an outlet port 11. The outlet port 11 of the muffler 10 and also continuous drill holes 13 formed in the cover plate 2*c* form an outlet of the pump 1. The base plate 2*a* is arranged on the mounting plate 6 on the side opposite the motor 5.

The inlet channel 8 is formed as an annular channel in the mounting plate 6 so that it is open toward the top according to the figures, that is, toward the base plate 2*a*, and also toward the inlet port 9. In terms of flow between the inlet channel 8 and the inlet openings of the base plate 2*a*, a filter 12 is arranged so that the air suctioned in the pump chamber 2 is completely freed from solid particles of harmful size.

Figure 4:
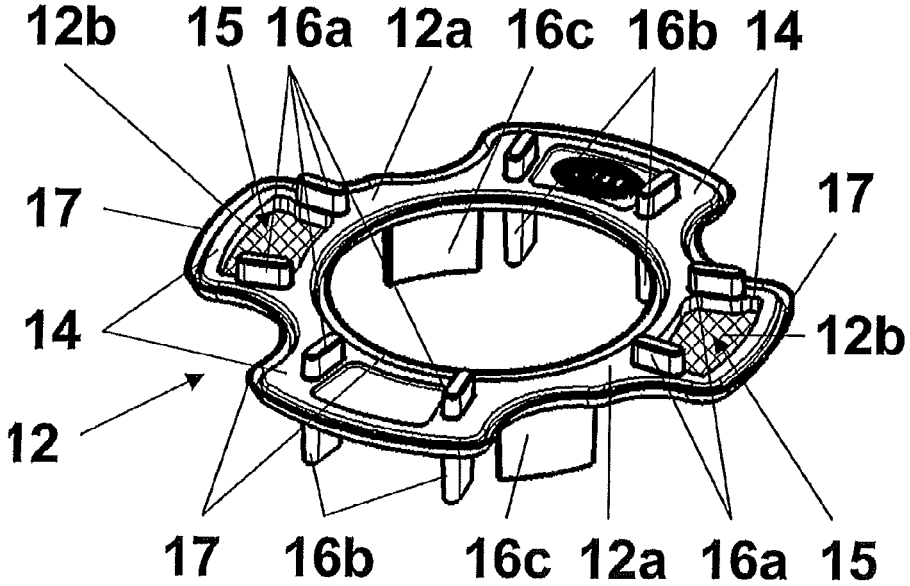

The filter 12 that is shown more clearly in FIG. 4 comprises a frame 12*a* and filter medium 12*b* that is shaped in the form, e.g., of a sieve, a fabric, or a non-woven material, preferably a fine-meshed stainless steel fabric, in the filter surface areas. The frame 12*a* is formed as a circular ring on whose outer periphery four arms 14 integrated with this ring are arranged distributed uniformly. The frame 12*a* thus forms, in top view, approximately a Celtic cross. Each of the arms 14 is formed approximately in the shape of a rectangle with slightly bent sides. In the top view, the frame 12*a* has the same shape as the inlet channel 8, wherein the frame 12*a* has a predetermined under-dimension. In two opposing arms 14, passage openings 15 are formed that are closed but still permeable to air with the filter medium 12*b*. The two other arms 14 are made from production-suitable reasons with a section of reduced material, that is, the frame 12*a* is produced with thinner material thickness within the corresponding arms 14 at predetermined points.

Sealing lips 17 are formed on an outer periphery and on an inner periphery of the frame 12*a*. These are formed either from the same material as the frame 12*a* in a suitable material thickness or from a separate elastic material so that the frame 12*a* has, together with the sealing lips 12, a predetermined over-dimension to the inlet channel 8.

On both main surfaces of the frame 12*a* there are elongated webs 16 that are perpendicular to these main surfaces. On the upper side of the frame 12 that points toward the base plate 2*c* when the pump is assembled, two first webs 16*a* are arranged on each of the arms 14 and oriented approximately in the radial direction. The first webs 16*a* are constructed next to the passage openings 15 or next to the section with thinner material. A height of the first webs 16*a* that is the distance of the top side of the frame 12*a* to the upper edge of the first webs 16*a* is dimensioned so that there is a predetermined minimum distance between the frame 12*a* and the base plate 2*c*.

On the bottom side of the frame 12*a* there are second and third webs 16*b*, 16*c* so that the filter assumes a predetermined axial position in the inlet channel 8 ("axial" is relative to the axis of the pump 1). A height of the second and third webs 16*b*, 16*c* is dimensioned accordingly, wherein the second webs 16*b* are lower by a very small amount of, e.g., approx. 0.1 mm.

The second webs 16*b* are arranged on the bottom side of the frame 12*a* only on the two arms 14 that are formed closed, that is, without the passage openings 15. The second webs 16*b* are arranged on these two arms 14 exactly opposite, that is, underneath the first webs 16*a*. The two other arms 14 with the passage openings 15 are constructed without webs pointing downward, in order to guarantee an optimum flow within the inlet channel 8 to the filter medium 12*b*.

The second webs 16*b* reliably prevent the corresponding arms 14 from being pressed too deeply into the inlet channel 8, so that no bypass to the filter 12 can be produced in the area of the inlet port 7 (in its upper area of the cross section).

The third webs 16*c* are likewise arranged on the bottom side of the frame 12*a* uniformly distributed on the annular part of the frame 12*a*. They define the axial position (parallel to the longitudinal axis of the pump 1) of the filter 12 in the inlet channel 8. The third webs 16*c* are constructed on the annular part of the frame 12*a* in approximately the center of the width.

This muffler 10 here surrounds the pump chamber 2 like a pot such that it encloses a volume for actively damping any noise. The muffler 10 is fastened tightly to the mounting plate 6, e.g., by means of screws. It is produced, e.g., from plastic or a lightweight metal alloy.

A front muffler that is not shown here is preferably integrated into the muffler 10. The front muffler is made from an elastic material, e.g., rubber.

The pump 1 is produced and assembled as follows. The muffler 10, optionally the front muffler, a seal 18, and the filter 12 (filter medium 12*b* injection molded at the same time) with the sealing lip 17 are produced using, e.g., injection molding. The motor 5 is fastened on the mounting plate 6. The filter 12 is pressed into the inlet channel 8, wherein the sealing lips 17 press against the walls of the inlet channel 8 and thus seal and clamp the filter 12 tightly against the inlet channel 8. The seal 18 is placed on the mounting plate 6 or in grooves formed here. Then the pump chamber 2 and the rotor with the gates are installed and fastened. The muffler 10, optionally with the inserted front muffler, is put over the pump chamber 2 and fastened on the mounting plate 6. The pump 1 produced in this way is fastened in a vehicle, connected electrically, and connected to a hose line on each inlet port 9 and outlet port 11.

During operation, the motor 5 is supplied with power and drives the rotor. In this way, air is suctioned through the inlet port 9 with the first hose and a low pressure that is needed on a load is generated. The suctioned air is freed from harmful particles in the filter 12, compressed in the pump chamber 2, and led through a pressure system—namely through drill holes 13 in the cover plate 2*c*, through the front muffler, then through the outlet channel 8, the muffler 10, the outlet port 11, and the second hose—into the surroundings. The inlet channel 8 underneath the filter 12 is dimensioned so that particles precipitated over the service life of the pump 1 can be stored.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

LIST OF REFERENCE SYMBOLS

1 Pump
2 Pump chamber
2*a* Base plate
2*b* Pump ring
2*c* Cover plate
5 Motor
6 Mounting plate
7 Connecting cable
8 Inlet channel
9 Inlet port
10 Muffler
11 Outlet port
12 Filter
12*a* Frame
12*b* Filter medium
13 Drill hole
14 Arm
15 Passage opening
16 Web
17 Sealing lip
18 Seal

The invention claimed is:

1. A pump, comprising:

a pump chamber having a rotor with gates supported in said pump chamber so that said rotor can rotate;

an electric motor operable to driving the rotor;

an outlet;

a mounting plate having an inlet port fastened thereto, wherein said inlet port is in active connection with an inlet channel;

a filter arranged in the inlet channel between the inlet port and the pump chamber, wherein the filter is provided with a frame with sealing lips; and wherein the frame includes a circular aperture extending through a middle portion thereof, wherein the frame includes filter surfaces formed as arms that extend outward from the circular aperture, and wherein each arm is disconnected from each other except via the circular aperture, thereby forming a cross shape such that an outer periphery of the frame is non-circular.

2. The pump according to claim 1, wherein webs are formed on the frame.

3. The pump according to claim 1, wherein the frame has a mirror-symmetric shape.

4. The pump according to claim 1, further comprising a muffler that encloses a volume around the pump chamber, the muffler being allocated to the outlet, wherein the volume is in active connection with an outlet port.

* * * * *